United States Patent [19]

Holcomb et al.

[11] Patent Number: 5,048,641

[45] Date of Patent: Sep. 17, 1991

[54] VAN-MOUNTED LADDER ASSEMBLY WITH CONCEALED RADIO ANTENNAS

[75] Inventors: Jack N. Holcomb, 1400 NW. 62nd St., Fort Lauderdale, Fla. 33307; Konrad K. Pangratz, Fort Lauderdale, Fla.

[73] Assignee: Jack N. Holcomb, Pompano Beach, Fla.

[21] Appl. No.: 617,780

[22] Filed: Nov. 23, 1990

[51] Int. Cl.[5] ..... H01Q 1/32; E06C 5/44; E06C 7/08

[52] U.S. Cl. ..... 182/127; 182/129; 343/713; 343/720

[58] Field of Search ..... 182/129, 219, 127; 343/713, 720, 711

[56] References Cited

U.S. PATENT DOCUMENTS

| | | | |
|---|---|---|---|
| 727,259 | 5/1903 | Baker | 182/219 |
| 3,696,431 | 10/1972 | Holland | 343/713 |
| 4,005,429 | 1/1977 | Ikrath | 343/713 |
| 4,008,838 | 2/1977 | Correll | 182/127 |
| 4,370,658 | 1/1983 | Hill | 343/713 |
| 4,535,336 | 8/1985 | Shaver | 343/713 |

*Primary Examiner*—Reinaldo P. Machado
*Attorney, Agent, or Firm*—Oltman and Flynn

[57] ABSTRACT

The present invention has a pair of hollow fiberglass ladders supported on top of the roof of a van by a support means including a hollow standard extending up from the roof and located between the inner sides of the two ladders. Antennas are located in the hollow outer sides of the ladders and electrical wiring for the antennas extends through hollow rungs of the ladders and through the hollow inner sides of the ladder, through the hollow standard, and down through an opening in the van roof to radio communication equipment inside the van.

13 Claims, 2 Drawing Sheets

L-1
L-2
S
R
B

VAN-MOUNTED LADDER ASSEMBLY WITH CONCEALED RADIO ANTENNAS

SUMMARY OF THE INVENTION

This invention relates to a van-mounted ladder assembly for use by law enforcement agents which holds a concealed antenna or antennas for radio communication equipment inside the van.

Law enforcement activities, particularly surveillance of a criminal suspect, often involves the use of very small radio transmitters of limited range. For example, a law enforcement agent or a witness cooperating with the government may carry a pistol containing a concealed radio transmitter, as disclosed in our U.S. Pat. No. 4,936,037. Typically, the signals broadcast by such a transmitter in a gun are received by a radio transmitter and tape-recorded by equipment located within the range of that transmitter.

The present invention facilitates the use of an automotive van as the site of such receiver and/or sound recording equipment as well as other radio communication equipment for transmitting, receiving or relaying signals relating to surveilance or other law enforcement activities. Preferably, the van looks like one of those commonly used by various equipment service personnel, such as telephone repairmen, TV antenna installers, or roof workers.

In accordance with the present invention, one or more conventional looking ladders on the outside of the van, preferably atop the roof, contain antennas and electrical wiring connecting them to the corresponding radio communication equipment inside the van. The opposite sides and at least some of the rungs of the ladder have hollow interiors to receive the wiring and the antennas. At least the part of each side where an antenna is located is of a suitable material, preferably fiberglass, that is substantially transparent to RF signals. Preferably, the ladder is hollow throughout and is of the same RF-transparent material throughout.

Preferably, the van roof has an opening for passing the electrical wiring to the radio communication equipment inside, and the ladder support means on top of the roof includes a hollow standard covering this van roof opening and adjoining the ladder or ladders mounted on the van roof. The electrical wiring for the antennas is entirely concealed by this hollow standard and the hollow ladder or ladders themselves so that there is nothing out of the ordinary in the appearance of the van and its ladder or ladders.

A principal object of this invention is to provide a novel van-mounted ladder assembly for holding a concealed radio antenna or antennas connected to concealed wiring extending between the antenna or antennas and corresponding radio equipment inside the van.

Another object of this invention is to provide such a ladder assembly that can be mounted on the roof of the van in such a way as to completely conceal the antenna or antennas and the wiring therefor, so as not to arouse the suspicion of a criminal suspect who is under surveillance by law enforcement agents.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
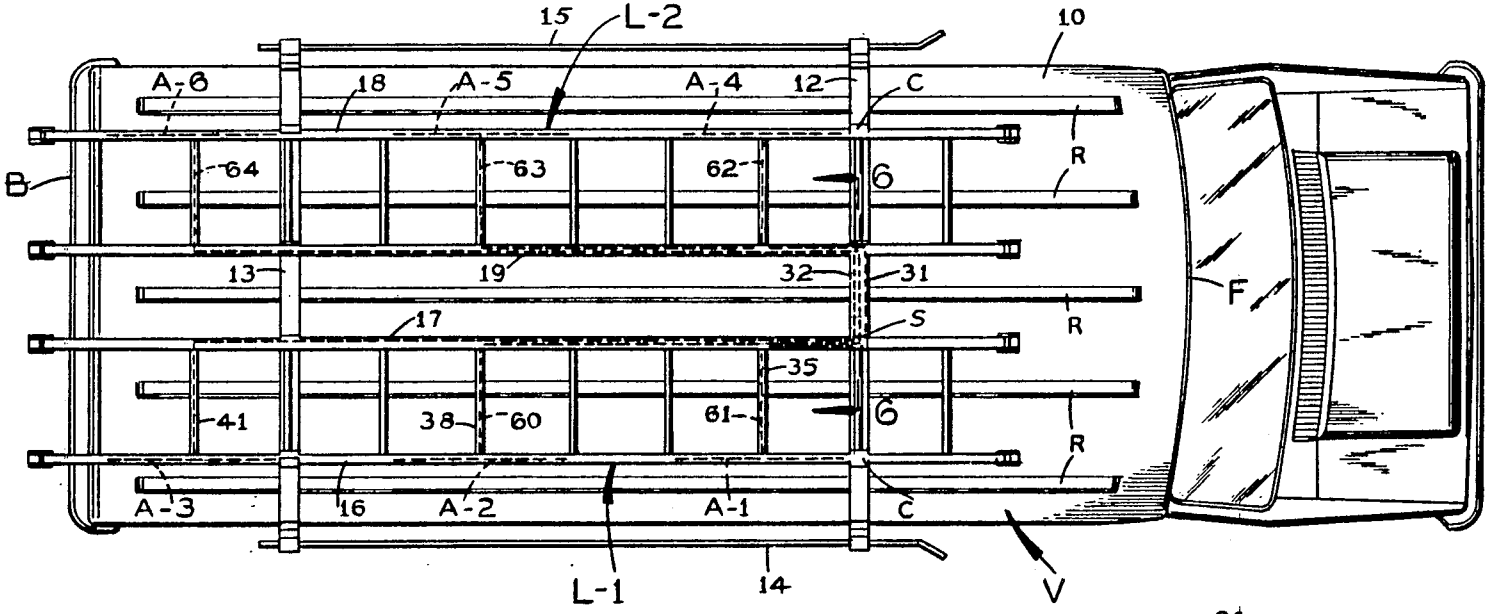
FIG. 1 is a top plan view of a van equipped with the present ladder assembly.

FIG. 1 shows a van V of the type used by many service technicians and therefore unlikely to attract notice. This van has a generally flat roof 10 formed with several upwardly offset, laterally spaced ribs R (FIG. 6) extending along most of the length of the roof.

In accordance with the preferred embodiment of the present invention, the van roof has an opening 11 located midway across the roof in a side-to-side direction and closer to the front edge F of the roof (FIG. 1) than to its back edge B.

A ladder support means of generally conventional appearance is mounted on the van roof for supporting two ladders L-1 and L-2. Each of these ladders is of a material strong enough to be used as a ladder and transparent to radio frequency signals. Preferably, the ladder material is fiberglass.

Figures 3, 4, 5, 6:
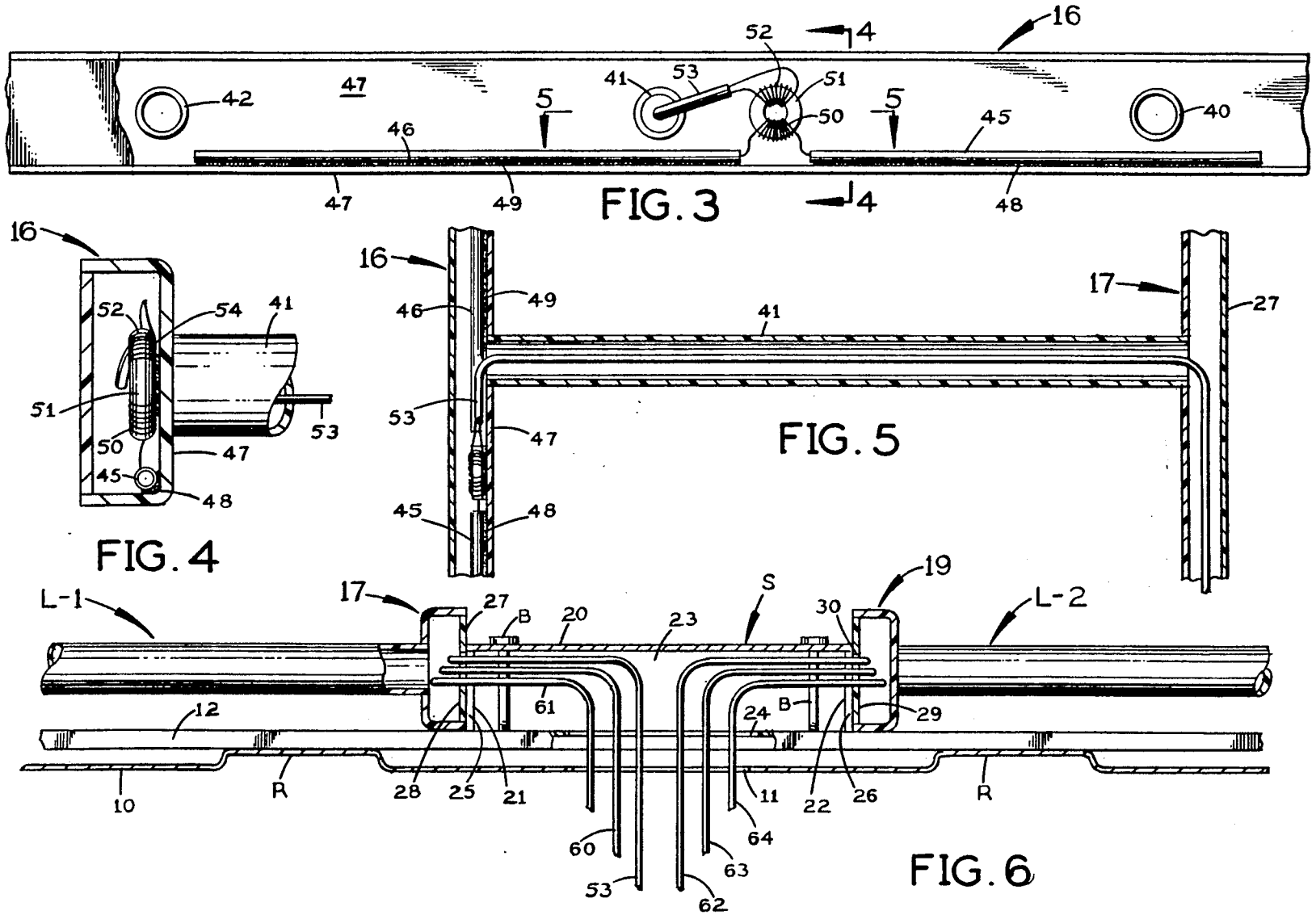
FIG. 3 is a longitudinal vertical section taken along the line 3—3 in FIG. 2 and showing one of the antennas in one hollow side of the ladder.
FIG. 4 is a fragmentary vertical cross-section taken along the line 4—4 in FIG. 3 through this side of the ladder.
FIG. 5 is a horizontal cross-section taken along the line 5—5 in FIG. 3 through the opposite sides of the ladder and the rung which passes electrical wiring from the antenna in one side.
FIG. 6 is a vertical cross-section taken along the line 6—6 in FIG. 1 and showing the wiring for the antennas passing through the roof of the van.

The ladder support means comprises a front cross-piece 12 (FIG. 1), a rear cross-piece 13, and opposite longitudinal pieces 14 and 15 extending between the cross-pieces and connected to them to provide a sufficiently rigid and strong physical support for the ladders. As shown in FIG. 6, the front cross-piece 12 of the ladder support means extends immediately above the raised ribs R of the van roof. This is also true of the rear cross-piece 13 of the ladder support means. Clips or brackets C of known design (FIG. 1) extend up from the rear cross-piece 13 and engage down over the outer side 16 and the inner side 17 of ladder L-1 and the outer side 18 and the inner side 19 of ladder L-2. Identical clips C extend up from the front cross-piece 12 and engage down over the outer sides 16 and 18 of the respective ladders. These hold-down clips hold the two ladders on the roof-mounted ladder support means in a known manner.

Figure 2:
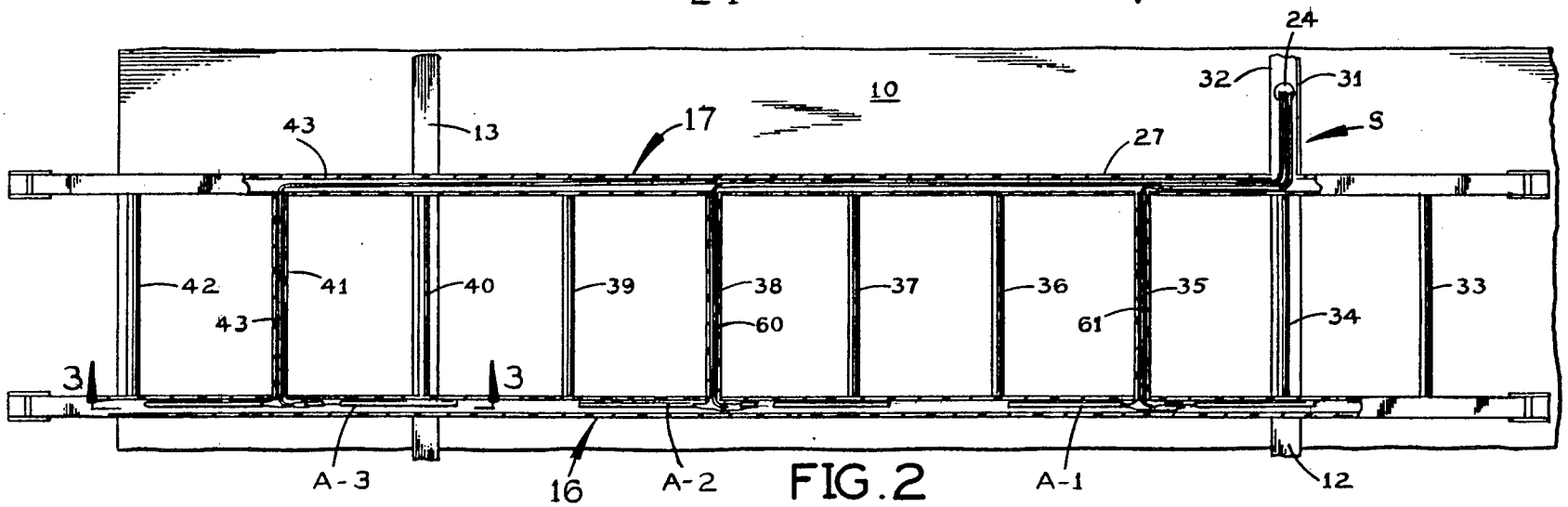
FIG. 2 is a view of one of the ladders shown partly in top plan and partly in horizontal section to reveal electrical wiring and antennas hidden in the ladder in accordance with this invention.

A hollow standard S extends up from the front cross-piece 12 of the ladder support means between the inner sides 17 and 19 of ladders L-1 and L-2. As shown in FIG. 6, this standard has a flat top wall 20, and opposite side walls 21 and 22, and opposite front and rear walls 31 and 32 (FIG. 2). Bolts B hold the standard down on the front cross-piece 12. Standard S has a hollow interior 23. The front cross-piece 12 has an opening 24 which communicates with the hollow interior of standard S and registers with the opening 11 in the van roof 10. Side wall 21 of standard S has an opening 25 which leads into its hollow interior 23. Likewise, the opposite side wall 22 of the standard has an opening 26 which leads into its hollow interior.

The inner side 17 of ladder L-1 has a hollow, generally rectangular cross-section along its entire length. Its flat outside wall 27 abuts against the adjacent side wall 21 of standard S and it has an opening 28 which registers with the side opening 25 in the standard.

Similarly, the inner side 19 of ladder L-2 has a hollow, generally rectangular cross-section along its entire length. Its flat outside wall 29 abuts against the adjacent side wall 22 of standard S and it has an opening 30 which registers with the side opening 26 in the standard.

Ladder L-1 has several hollow rungs 33, 34, 35, 36, 37, 38, 39, 40, 41 and 42 (FIG. 2) evenly spaced apart along the length of its opposite sides 16 and 17. The hollow interior of each rung opens at one end into the hollow interior of the inner side 17 of the ladder and opens at the opposite end into the hollow interior of the outer side 16 of this ladder.

Three antennas A-1, A-2 and A-3 are received in the hollow interior of the outer side 16 of ladder L-1. These antennas are spaced apart lengthwise of the ladder on this side. FIG. 3 shows one of these antennas A-3 as a dipole antenna of conventional design. It has two straight elongated radiating elements 45 and 46, which may be copper foil strips, attached to the inside of the inside wall 47 (FIGS. 3, 4 and 5) of the outer side 16 of ladder L-1 by suitable adhesive layers 48 and 49 (FIG. 3), respectively. Radiating elements 45 and 46 are connected to the opposite ends of a winding 50 on a "Balun" transformer of conventional design (FIG. 3) having a toroidal ferromagnetic core 51. The Balun transformer has another winding 52 whose opposite ends are connected respectively to the inner conductor and the grounded outer sheath of one end of a coaxial cable 53, the opposite end of which is connected to radio communication equipment in the van, such as a radio transmitter, a radio receiver, a transceiver, or a repeater. As shown in FIG. 4, the core 51 of the Balun transformer is affixed to wall 47 of the outer side 16 of this ladder by an adhesive layer 54. Preferably, the adhesive for both radiating elements 45 and 46 and the transformer core 51 is "RTV 103" silicone rubber adhesive sealant manufactured by GE. Preferably, the cable 53 is glued in place to the same wall of this side of the ladder by the same adhesive.

It is to be understood that one or more of the antennas A-1, A-2 and A-3 may have a special design, different from the one shown in FIG. 3, to optimize its performance with the particular communication gear in the van that it serves.

The cable 53 for antenna A-3 extends through the hollow interior of ladder rung 41 (FIGS. 2 and 5) and from there it extends through the hollow interior of the inner leg 17 of ladder L-1, passing through the opening 28 (FIG. 6) in the outside of this ladder leg and the opening 25 in the adjoining side 21 of standard S into the hollow interior 23 of the standard, and down through the opening 24 in front cross-piece 12 of the ladder support means and the opening 11 in the top 10 of the van to a particular communication equipment inside the van.

In like manner, antenna A-2 is connected by electrical wiring 60 (a coaxial cable), as shown in FIGS. 1 and 2, to corresponding communication equipment inside the van. Cable 60 extends from antenna A-2 through ladder rung 38 and from there along the inside of the inner side 17 of ladder L-1 into and through the standard S, as shown in FIG. 6.

Similarly, antenna A-1 is connected by a cable 61 (FIGS. 1 and 2), passing through ladder rung 35 and along the inside of the inner side 17 of ladder L-1 into and through the standard S, as shown in FIG. 6.

Three additional antennas A-4, A-5, and A-6 are positioned in the hollow interior of the outer side 18 of the other ladder L-2 on the roof of the van, as shown schematically in FIG. 1. These antennas are connected to respective coaxial cables 62, 63 and 64 (FIG. 6) which lead to corresponding radio communication equipment inside the van. These cables extend through corresponding rungs of ladder L-2 and along the inside of the inner side 19 of the ladder, passing through the opening 30 in this side of the ladder and the aligned side opening 26 in side wall 22 of standard S into the hollow interior 23 of the standard, and then down through the opening 24 in the front cross-piece 12 of the ladder support means on the van roof and through the opening 11 in the van roof to the corresponding communication equipment inside the van.

From the foregoing it will be evident that the disclosed arrangement provides a convenient and effective way of concealing the surveillance purpose of what appears to be an ordinary van used by different types of service technicians and the like. If desired, the present invention may be embodied in an arrangement in which a ladder is mounted on the side of the van instead of the roof. However, the roof mounting is preferred for maximum security against detection of the surveillance nature of the equipment.

We claim:

1. A ladder assembly for use on a van having an opening therein, said ladder assembly comprising:

ladder support means for attachment to said van to support a ladder on said van, said support means including a standard having a hollow interior adapted to communicate with said van opening to pass electrical wiring, said standard having a side opening communicating with said hollow interior;

a ladder having first and second, opposite, elongated sides and a plurality of rungs extending between said sides;

said first side of the ladder extending next to said standard and having an opening registering with said side opening in said standard, said first side having a hollow interior extending lengthwise of said first side away from said opening in said first side;

at least one of said rungs having a hollow interior communicating with said hollow interior of said first side;

said second side of the ladder having a hollow interior communicating with the hollow interior of said one rung, said second side of the ladder being substantially transparent to RF signals;

an antenna in the hollow interior of said second side;

and electrical wiring connected to said antenna and extending therefrom through the hollow interior of said one rung, through the hollow interior of said first side, from said one rung to said standard, and through the hollow interior of said standard to pass through said opening in the van.

2. A ladder assembly according to claim 1 wherein:

said plurality of rungs include a second rung with a hollow interior communicating at its opposite ends with the hollow interior of said first side and the hollow interior of said second side of the ladder;

and further comprising:

a second antenna in the hollow interior of said second side of the ladder;

and electrical wiring connected to said second antenna and extending therefrom through the hollow interior of said second rung, through the hollow interior of said first side from said second rung to said standard, and through the hollow interior of said standard to pass through said opening in the van.

3. A ladder assembly for use on a van with a roof having an opening therein, said ladder assembly comprising:

ladder support means for attachment to said roof to support a ladder on top of the roof, said support means including a standard having a hollow interior adapted to communicate with said roof opening to pass electrical wiring, said standard having a side opening communicating with said hollow interior;

a ladder having first and second, opposite, elongated sides and a plurality of rungs extending between said sides;

said first side of the ladder extending next to said standard and having an opening registering with said side opening in said standard, said first side having a hollow interior extending lengthwise of said first side away from said opening in said first side;

at least one of said rungs having a hollow interior communicating with said hollow interior of said first side;

said second side of the ladder having a hollow interior communicating with the hollow interior of said one rung, said second side of the ladder being substantially transparent to RF signals;

an antenna in the hollow interior of said second side;

and electrical wiring connected to said antenna and extending therefrom through the hollow interior of said one rung, through the hollow interior of said first side, from said one rung to said standard, and through the hollow interior of said standard to pass down through said opening in the van roof.

4. A ladder assembly according to claim 3 wherein:

said plurality of rungs include a second rung with a hollow interior communicating at its opposite ends with the hollow interior of said first side and the hollow interior of said second side of the ladder;

and further comprising:

a second antenna in the hollow interior of said second side of the ladder;

and electrical wiring connected to said second antenna and extending therefrom through the hollow interior of said second rung, through the hollow interior of said first side from said second rung to said standard, and through the hollow interior of said standard to pass through said opening in the van roof.

5. A ladder assembly for use on a van with a roof having an opening therein, said ladder assembly comprising:

ladder support means for attachment to said roof to support two ladders on top of the roof, said support means including a standard having a hollow interior adapted to communicate with said roof opening, said support means having opposite first and second side openings communicating with said hollow interior;

first and second ladders on opposite sides of said standard, each of said ladders having inner and outer, opposite, elongated hollow sides and a plurality of hollow rungs extending between said inner and outer sides, said outer sides of said ladders being substantially transparent to RF signals;

said inner side of said first ladder having an opening therein which registers with said first side opening in said standard;

a plurality of first antennas spaced apart along the inside of said hollow outer side of said first ladder;

first electrical wiring connected to said first antennas and extending through said hollow rungs to said inner side of said first ladder, along the inside of said inner side of said first ladder to said standard, and through said standard to pass down through said opening in the van roof;

said inner side of said second ladder having an opening therein which registers with said second side opening in said standard;

a plurality of second antennas spaced apart along the inside of said hollow outer side of said second ladder;

and second electrical wiring connected to said second antennas and extending through said hollow rungs to said inner side of said second ladder, along the inside of said inner side of said second ladder to said standard, and through said standard to pass down through said opening in the van roof.

6. A ladder assembly for use on a van having an opening therein, said ladder assembly comprising:

ladder support means for attachment to said van to support a ladder on said van, said support means including a standard having a hollow interior adapted to communicate with said opening in the van, said standard having an opening communicating with said hollow interior;

a ladder having first and second, opposite, elongated sides and a plurality of rungs extending between said sides;

said first side of the ladder extending next to said standard and having an opening registering with said opening in said standard, said first side having a hollow interior extending lengthwise of said first side away from said opening in said first side for receiving electrical wiring extending from said opening in the van through the hollow interior of said standard;

at least one of said rungs having a hollow interior communicating with said hollow interior of said first side for passing said electrical wiring;

and said second side of the ladder having a hollow interior communicating with the hollow interior of said one rung for receiving said wiring and an antenna connected to said wiring, said second side of the ladder being substantially transparent to RF signals.

7. A ladder assembly for use on a van with a roof having an opening therein, said ladder assembly comprising:

ladder support means for attachment to said roof to support a ladder on top of the roof, said support means including a standard having a hollow interior adapted to communicate with said roof opening, said standard having a side opening communicating with said hollow interior;

a ladder having first and second, opposite, elongated sides and a plurality of rungs extending between said sides;

said first side of the ladder extending next to said standard and having an opening registering with said side opening in said standard, said first side having a hollow interior extending lengthwise of said first side away from said opening in said first side for receiving electrical wiring extending from said opening in the van roof through the hollow interior of said standard;

at least one of said rungs having a hollow interior communicating with said hollow interior of said first side for passing said electrical wiring;

and said second side of the ladder having a hollow interior communicating with the hollow interior of said one rung for receiving said wiring and an antenna connected to said wiring, said second side of the ladder being substantially transparent to RF signals.

8. In combination, a van having an opening therein;

ladder support means on said van;

a ladder on said support means having a hollow interior, at least a portion of said ladder being substantially transparent to RF signals;

an antenna in the hollow interior of said ladder at said portion of the ladder which is substantially transparent to RF signals;

and electrical wiring connected to said antenna and extending through the hollow interiors of said ladder and through said opening in the van into the interior of the van.

9. In combination, a van having a roof with an opening therein;

ladder support means on top of said roof;

a ladder on said support means having a hollow interior, at least a portion of said ladder being substantially transparent to RF signals;

an antenna in the hollow interior of said ladder at said portion of the ladder which is substantially transparent to RF signals;

and electrical wiring connected to said antenna and extending through the hollow interiors of said ladder and through said opening in the van roof into the interior of the van below said roof.

10. The combination of claim 9 wherein:

said ladder support means includes a standard having a hollow interior adapted to communicate with said opening in the van roof, said standard having a side opening therein;

said ladder has first and second, opposite, elongated sides and a plurality of rungs extending between said sides;

said first side of the ladder extends next to said standard and has an opening registering with said side opening in the standard;

said first side has a hollow interior extending lengthwise of said first side away from said standard and receiving said wiring.

11. The combination of claim 10 wherein:

at least one of said rungs has a hollow interior communicating with the hollow interior of said first side and receiving said wiring;

said second side of the ladder has a hollow interior communicating with the hollow interior of said one rung and receiving said antenna.

12. The combination of claim 11 wherein:

said plurality of rungs include a second rung with a hollow interior communicating at its opposite ends with the hollow interior of said first side and the hollow interior of said second side of the ladder;

said electrical wiring includes additional wiring extending from the hollow interior of said second side through said second rung and through said first side to said standard;

and further comprising:

a second antenna in the hollow interior of said second side and connected to said additional wiring.

13. In combination, a van having a roof with an opening therein;

ladder support means on top of said roof for supporting two ladders above the roof, said support means including a standard having a hollow interior adapted to communicate with said opening in the van roof, said standard having opposite first and second side openings communicating with said hollow interior;

first and second ladders on opposite sides of said standard, each of said ladders having inner and outer opposite, elongated, hollow sides and a plurality of hollow rungs extending between said inner and outer sides, said outer sides of said ladders being substantially transparent to RF signals;

said inner side of said first ladder having an opening therein which registers with said first side opening in said standard;

a plurality of first antennas spaced apart along the inside of said hollow outer side of said first ladder;

first electrical wiring connected to said first antenna and extending through said hollow rungs to said inner side of said first ladder, along the inside of said inner side of said first ladder to said standard, and through said standard to pass down through said opening in the van roof;

said inner side of said second ladder having an opening therein which registers with said second side opening in said standard;

a plurality of second antennas spaced apart along the inside of said hollow outer side of said second ladder;

and second electrical wiring connected to said second antennas and extending through said hollow rungs to said inner side of said second ladder, along the inside of said inner side of said second ladder to said standard, and through said standard to pass down through said opening in the van roof.

* * * * *